US008317010B2

(12) United States Patent
Riedel et al.

(10) Patent No.: US 8,317,010 B2
(45) Date of Patent: Nov. 27, 2012

(54) TRANSFER SYSTEM CO-OPERATING WITH A MACHINE FOR PRODUCING TOBACCO AND FILTER PRODUCT RODS AS WELL AS METHOD OF TRANSFERRING SUCH RODS WITHIN THE TRANSFER SYSTEM

(75) Inventors: Michael Riedel, Geldern (DE); Hans-Reiner Hoffmann, Grevenbroich (DE)

(73) Assignee: International Tobacco Machinery Poland Sp. z.o.o., Radom (PL)

( * ) Notice: Subject to any disclaimer, the term of this patent is extended or adjusted under 35 U.S.C. 154(b) by 312 days.

(21) Appl. No.: 12/659,603

(22) Filed: Mar. 15, 2010

(65) Prior Publication Data

US 2010/0236893 A1 Sep. 23, 2010

(30) Foreign Application Priority Data

Mar. 13, 2009 (PL) ..... 387485

(51) Int. Cl.
*B65G 47/26* (2006.01)
*B07C 5/00* (2006.01)

(52) U.S. Cl. ..... 198/438; 209/535; 131/907

(58) Field of Classification Search ..... 198/339.1, 198/341.01, 436, 438; 209/535–537; 131/280, 131/907

See application file for complete search history.

(56) References Cited

U.S. PATENT DOCUMENTS 2,246,107 A * 6/1941 Ruau ..... 209/535
3,491,767 A * 1/1970 Kaeding ..... 131/94
3,828,796 A 8/1974 Finn
4,175,479 A * 11/1979 Roullier ..... 493/4
4,277,678 A * 7/1981 Wahle et al. ..... 250/223 R
4,484,591 A * 11/1984 Wahle et al. ..... 131/280
4,574,646 A * 3/1986 Mattei et al. ..... 73/863.92
4,825,994 A * 5/1989 Gomann et al. ..... 198/370.12
4,962,771 A * 10/1990 Neri et al. ..... 131/282
5,232,079 A * 8/1993 Belcastro et al. ..... 198/370.11

(Continued)

FOREIGN PATENT DOCUMENTS

DE 1 632 251 12/1970

(Continued)

OTHER PUBLICATIONS

Notification of European publication number and information on the application of Article 67(3) EPC; Application No. 101559662.3—2313 / 2227979 (2 pgs) dated Aug. 18, 2010.

(Continued)

*Primary Examiner* — Douglas Hess
(74) *Attorney, Agent, or Firm* — Nixon & Vanderhye

(57) ABSTRACT

Transfer system cooperating with a machine for producing tobacco and filter product rods having a rod receiving unit, a cutting head, and a control system. The machine enables adjustment of the length of the produced rods, whereby the rod receiving unit of the transfer system is synchronized with the cutting head by the control system. The transfer system is situated between the machine for producing rods and a machine for further processing or transmitting the rods. A rejection unit is provided for rejecting the rods outside the transfer system during the synchronization of the rod receiving unit of the transfer system with the cutting head after a new length is entered into the control system. The rejection unit is located between the cutting head of the machine and the rod receiving unit.

10 Claims, 2 Drawing Sheets

U.S. PATENT DOCUMENTS

| | | | | |
|---|---|---|---|---|
| 5,327,803 | A | 7/1994 | deMey, III | |
| 5,490,527 | A * | 2/1996 | Irikura et al. | 131/280 |
| 5,615,761 | A | 4/1997 | Draghetti et al. | |
| 5,695,070 | A * | 12/1997 | Draghetti | 209/536 |
| 6,213,309 | B1 * | 4/2001 | Dadisho | 209/523 |
| 6,247,577 | B1 | 6/2001 | Dahlgrun et al. | |
| 6,253,651 | B1 * | 7/2001 | Bessemer | 83/42 |
| 6,368,041 | B1 * | 4/2002 | Atwell et al. | 414/295 |
| 6,808,059 | B2 * | 10/2004 | Nagai et al. | 198/370.11 |
| 7,131,524 | B2 | 11/2006 | Wohltmann | |
| 7,281,621 | B2 * | 10/2007 | Jahnke et al. | 198/471.1 |
| 7,510,068 | B2 * | 3/2009 | Rizzoli et al. | 198/471.1 |
| 2004/0102864 | A1 | 5/2004 | Stack et al. | |

FOREIGN PATENT DOCUMENTS

| | | | |
|---|---|---|---|
| DE | 3 423 570 | A1 | 1/1985 |
| EP | 0 594 397 | A1 | 4/1994 |
| FR | 2 394 991 | A1 | 1/1979 |

OTHER PUBLICATIONS

European Search Report; Application No. EP 10 15 5962, dated Jun. 15, 2010.

* cited by examiner

TRANSFER SYSTEM CO-OPERATING WITH A MACHINE FOR PRODUCING TOBACCO AND FILTER PRODUCT RODS AS WELL AS METHOD OF TRANSFERRING SUCH RODS WITHIN THE TRANSFER SYSTEM

The object of the invention is a transfer system co-operating with a machine for producing tobacco and filter product rods as well as a method of transferring such rods within the transfer system.

The invention relates to the domain of tobacco production and especially the production of cigarettes and filter rods. More specifically, the invention concerns a method of synchronization of a rod like article making machine (rod making machine) equipped with a rod receiving unit implemented in a transfer system of a rod making machine (further in the description the word "rod" means a cigarette or a filter rod).

Machines used in the tobacco industry which produce rods are typically coupled with the machines in which rods are subjected to further operations, and with the machines collecting rods in trays or with the assemblies for transporting the rods by means of transfer units and control systems. During the transfer of the rods a change of rod movement direction form lengthwise to lateral takes place.

PRIOR ART

In the machines described above a continuous cigarette or filter rod is cut into rods by means of a cutting head, the rods moving subsequently one after another in the same direction and with the same speed as the original continuous rod. Transfer assemblies are known in the state of the art which change the direction of movement of rods from longitudinal to lateral. These known assemblies make use of the drums that receive consecutive longitudinally moving rods, as described in the document DE 16 32 251. The rods plunge into consecutive flutes of the rotating drum which forms part of the receiving unit mechanically coupled with the cutting head.

Patent EP 0 682 881 describes a device, in which filter rods are produced from two continuous cigarette rods by way of cutting them with one cutting head, the transfer system being equipped with rod accelerating elements. The movement of the cutting head is coupled with two receiving drums of the receiving unit, whereas the rods from two respective streams plunge into the flutes of each of the drums, the rods being accelerated and the drums rotating in opposite directions.

Another receiving unit being a part of a transfer system is presented in the document EP 0 594 397. The linear moving cigarette rods are lifted by suction nozzles approaching them from above and are transferred onto a drum on which the rods move transversely to their axes. The cutting head, the receiving unit and the transporting drum of the transfer system are mechanically coupled.

All the above mentioned transfer assemblies are mechanically coupled with the cutting head of the rod making machine. Whenever the length of the produced rods is changed, synchronization of the transfer system with the cutting head on the rod making machine is required.

The distance between the cutting head and the receiving unit of the transfer system is constant. In the case of every change of the length of the rods being produced, the receiving unit must be disengaged from the cutting head, their new mutual position must be adjusted and they must be coupled again, which in turn requires verifying the correctness of the transfer. In order to achieve this, the production of a new continuous cigarette or filter rod must be started; then it must be stopped again in order to check whether the rods are properly received by the receiving unit. It further requires turning the machine manually and checking whether the rods are being led unobstructively into the flutes of the receiving drum or whether the rods transferred by the suction nozzles are placed in the transport drums so that further processing is enabled. The synchronization of the receiving unit with the cutting head requires several steps in order to achieve the correct transfer of the rods.

When small batches of a certain product are produced, both frequent machine adjustments and the synchronization of transfer system are required. Therefore there is a demand of cigarette manufacturers for solutions which ensure shortening the time required for the machine adjustments.

When using the known machines (machines where the rods are subject to further processing), a problem arises of synchronization of the rod making machine with the receiving unit when the length of the rods being produced must be changed, i.e. after the machine has been re-adjusted to another length of rods. The problem results from the fact that switching the machine on after the rod length adjustment causes a disturbance in the rod transfer. The disturbance appears for a short time, just before the rod making machine becomes resynchronized with the rod receiving unit by the control system. After the machine has been re-adjusted to another length, the receiving unit is usually incorrectly set with relation to the cutting head and the transferred rods are being choked.

In the known machines the re-synchronization of the whole system is a time consuming and inconvenient process.

SUMMARY OF THE INVENTION

According to the invention a transfer system is provided, cooperating with a machine for producing tobacco and filter product rods comprising a cutting head, the machine being synchronized with a rod receiving unit of the transfer system and enabling adjustment of the length of the produced rods, the transfer system being situated between the machine for producing rods and a machine for further processing or transmitting the rods, and characterized in that it comprises a rejection unit for rejecting the rods outside the transfer system, the rejection unit being located between the cutting head of the machine and the rod receiving unit.

Preferably the rejection unit comprises a compressed air nozzle.

Also preferably a rod end detector is provided in the rejection unit between the cutting head and the compressed air nozzle.

The rod end detector is advantageously a photocell.

The compressed air nozzle may be provided with a cut-off valve.

According to the invention a method is provided for transferring rods in a transfer system of a machine for producing tobacco and filter product rods, enabling adjustment of the length of the produced rods, in which the produced rods of a defined length are cut off from a continuous rod by means of a cutting head of the machine, the cut rods being then transferred to a receiving unit, characterized in that, after every change of the length of the cut rods, during the synchronization of the receiving unit and the cutting head, the produced rods are being rejected outside the transfer system by means of a rejection unit.

Preferably the rejection is effected by means of a compressed air jet.

The synchronization of the receiving unit with the cutting head is advantageously initiated by a signal generated by the rod end detector.

The jet of compressed air is advantageously released and cut-off by means of a cut-off valve.

The rod end detector is preferably a photocell.

The present state of technology makes it possible to apply high quality servomotors for independent driving both assemblies of the transfer system and the cutting head as well as to apply systems for automatic resynchronization of control systems. The change of the length of the produced rods requires synchronization of the transfer system irrespective of the level of automation of the functions realized on the machine. In the case of highly automated synchronization of the receiving unit with the cutting head, rejection of the produced rods outside the transfer system ensures that none of the manufactured rods will enter the receiving unit until both units have been synchronized. Owing to the above, undisturbed operation is ensured both during the synchronization and after a new supply of the rods to the synchronized system have been released.

SHORT DESCRIPTION OF THE DRAWING

Exemplary embodiment of the invention is presented in the drawing in which.

DETAILED DESCRIPTION OF THE EXEMPLARY EMBODIMENT OF THE INVENTION

Figure 1:
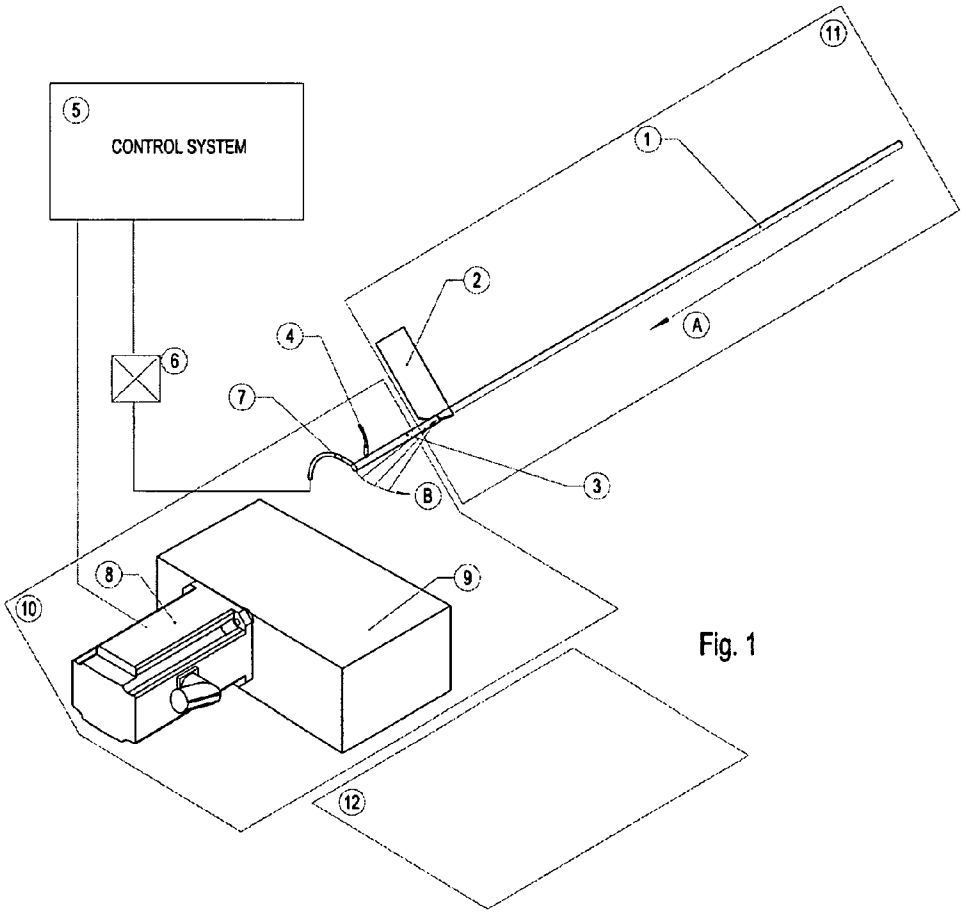
FIG. 1 represents the transfer system according to the invention when the rods are not being rejected outside the transfer system.
Figure 2:
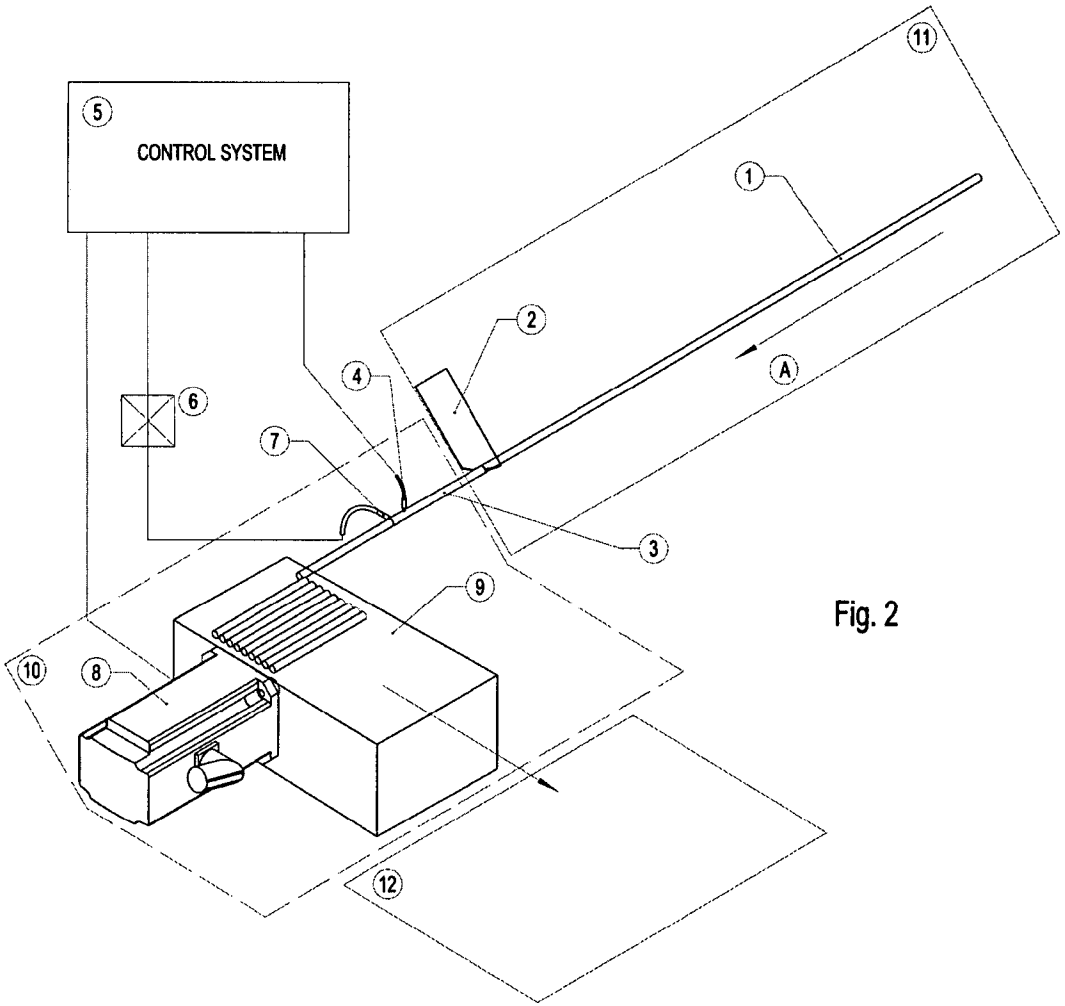
FIG. 2 represents the transfer system according to the invention when the rods are being rejected outside the transfer system.

As it can be seen in FIGS. 1 and 2, a machine 11 for producing rods cooperates with a machine 12 for further processing or transmitting the rods by means of a transfer system 10. In the transfer system 10 the direction of the movement of the rods is changed from longitudinal to lateral. The transfer system 10 according to the invention comprises a rejection unit and a receiving unit 9. The rejection unit comprises a nozzle of compressed air 7 and a detector 4.

FIG. 1 shows the transfer system 10 during the synchronization of the machine 11 with the transfer system 10, right after a change of the length of the rods being produced on the machine 11, when the rejection unit is operating and the rods are being rejected in the direction B by means of compressed air form the nozzle 7 outside the transfer system.

FIG. 2 shows the transfer system 10 when all the units are operating after the adjustment to a defined length of rods.

As explained above, the machine for producing rods may be adjusted depending on the required length of the produced rods. The data relating to the new length is entered to the control system 5 during a stoppage of the machine operation. Then the machine is activated again so that it starts forming a continuous rod 1 which will be transferred to be cut off with a knife of a cutting head. The first cut off rod 3 is being moved along its path and that the arrival of the leading end of the rod 3 in front of a detector 4 will cause sending a signal from the detector 4 to the control system 5. From that moment, the process of synchronization of the receiving unit 9 with the cutting head 2 for a certain length of the produced rods with relation to the reference synchronization set previously for the receiving unit 9 and the cutting head 2 is being effected by the control system 5 of the machine. During the process of synchronization all the produced rods 3 are being rejected by the rejection unit. When the process of synchronization has been completed the rejection unit is switched off by the control system 5 and the transfer system is operating without rejecting rods. The rejection unit is switched on and off by means of a valve 6 supplying the compressed air to the nozzle 7.

The invention claimed is:

1. A transfer system cooperating with a machine for producing tobacco and filter product rods comprising:

a rod receiving unit;

a cutting head;

a control system;

the machine enabling adjustment of the length of the produced rods, the rod receiving unit of the transfer system being synchronized with the cutting head by the control system, the transfer system being situated between the machine for producing rods and a machine for further processing or transmitting the rods; and a rejection unit for rejecting the rods outside the transfer system during the synchronization of the rod receiving unit of the transfer system with the cutting head after a new length is entered into the control system, the rejection unit being located between the cutting head of the machine and the rod receiving unit.

2. The transfer system according to claim 1, wherein the rejection unit comprises a compressed air nozzle.

3. The transfer system according to claim 2, wherein a rod end detector is provided in the rejection unit between the cutting head and the compressed air nozzle.

4. The transfer system according to claim 3, wherein the rod end detector is a photocell.

5. The transfer system according to claim 2, wherein the compressed air nozzle is provided with a cut-off valve.

6. A method for transferring rods in a transfer system of a machine for producing tobacco and filter product rods, enabling adjustment of the length of produced rods, comprising cutting off the produced rods of a defined length from a continuous rod by means of a cutting head of the machine, and then transferring the cut rods to a receiving unit, wherein, after every change of the length of the cut rods, during the synchronization of the receiving unit and the cutting head, the produced rods are rejected outside the transfer system by means of a rejection unit.

7. The method according to claim 6, wherein the rejection is effected by means of a compressed air nozzle.

8. The method according to claim 6, wherein the synchronization of the receiving unit with the cutting head is initiated by a signal generated by a rod end detector.

9. The method according to claim 7, wherein the compressed air is released and cut-off by means of a cut-off valve.

10. The method according to claim 8, wherein the rod end detector is a photocell.

* * * * *